US005183402A

United States Patent [19]

Cooke et al.

[11] Patent Number: 5,183,402

[45] Date of Patent: Feb. 2, 1993

[54] WORKPIECE SUPPORT

[75] Inventors: Michael J. Cooke, Thornbury; Arthur J. McGeown, Bristol, both of England

[73] Assignee: ELECTROTECH Limited, Bristol, England

[21] Appl. No.: 699,577

[22] Filed: May 14, 1991

[30] Foreign Application Priority Data

May 15, 1990 [GB] United Kingdom ..... 9010833

[51] Int. Cl.[5] ..... F27D 5/00

[52] U.S. Cl. ..... 432/5; 432/231; 432/249; 432/253

[58] Field of Search ..... 432/231, 247, 249, 253, 432/258, 241, 5

[56] References Cited

U.S. PATENT DOCUMENTS

| | | | |
|---|---|---|---|
| 2,798,716 | 7/1957 | Pugh | 432/249 |
| 3,951,587 | 4/1976 | Alliegro et al. | 432/258 |
| 4,259,061 | 3/1981 | Dubetsky | 432/258 |
| 4,610,628 | 9/1986 | Mizushina | 432/253 |
| 4,613,305 | 9/1986 | Sakurai | 432/253 |
| 5,044,943 | 9/1991 | Bowman et al. | 432/231 |

FOREIGN PATENT DOCUMENTS

| | | |
|---|---|---|
| 0015234A1 | 1/1980 | European Pat. Off. . |
| 0016579A1 | 3/1980 | European Pat. Off. . |
| 0250064A2 | 12/1987 | European Pat. Off. . |
| 0290218A2 | 11/1988 | European Pat. Off. . |
| 0326838A1 | 8/1989 | European Pat. Off. . |

*Primary Examiner*—Henry C. Yuen
*Attorney, Agent, or Firm*—Larson and Taylor

[57] ABSTRACT

An apparatus for supporting a workpiece has an enclosure, a means for reducing the pressure and a platen on which the workpiece is mounted. A heating mechanism is located within the platen and the platen is coated with a high emissivity material, which facilitates the radiative heat transfer between the platen and the workpiece. Consequently, the workpiece can be rapidly raised to a specific temperature. This apparatus is particularly applicable to the supporting of a semiconductor wafer within a vacuum system.

15 Claims, 2 Drawing Sheets

WORKPIECE SUPPORT

BACKGROUND OF THE INVENTION

1. Field of the Invention

The present invention relates to an apparatus for supporting a workpiece. It is particularly, but not exclusively, concerned with supporting a semiconductor wafer within a vacuum system.

2. Summary of the Prior Art

In processing a semiconductor wafer, it is often necessary to carry out at least some of the processing at reduced pressure. Processes needing this include thin film sputtering, plasma etching, and chemical vapour deposition including plasma enhanced chemical vapour deposition. In an apparatus for processing a semiconductor wafer, the semiconductor wafer is supported on a platen within an enclosure, and then the pressure is reduced within that enclosure. It is important to ensure that there is no contamination of the wafer from e.g. the fabric of the platen. For this reason, it is standard practice to use a metal platen with a highly polished surface, so that the risk of contamination of the wafer is minimised.

When carrying out processing of a semiconductor wafer, it is usually necessary to achieve a specific wafer temperature rapidly, and to maintain that specific temperature during the processing operation. Techniques for controlling the temperature of the platen and of the enclosure are well established, but such techniques do not always achieve the result of satisfactory control of wafer temperature. In particular, there is normally high thermal resistance between the wafer and the platen and, although proposals have been made to overcome this problem by mechanically clamping the wafer to the platen, or by introducing gas between the wafer and the platen, such techniques have not been wholly successful. The introduction of gas also has the disadvantage of causing a stress on the wafer, and mechanical clamping may generate particles.

SUMMARY OF THE INVENTION

Therefore, according to the present invention, it is proposed that the surface of the platen adjacent the workpiece is coated with a coating which assists heat transfer to or from the workpiece.

It can be appreciated that, of the ways that heat can be transferred to or from the wafer, convection makes a negligible contribution in the case of processing a semiconductor wafer, since the pressure is normally reduced. At first sight, therefore the alternative to convection is conduction, and the prior art proposals have all sought to increase conduction, e.g. by the clamping arrangement discussed above. However, the applicants have investigated the amount of conduction between a semiconductor wafer and a platen when the wafer is unclamped on a flat metallic platen with less than one Torr of gas present, and have found that the linear heat transfer coefficient is of the order of 10 Watts meter$^{-2}$ Kelvin$^{-1}$. The applicants have appreciated that the heat transferred from the wafer by radiation can be comparable with this figure for wafer temperatures as low as 400 Kelvin, and therefore it becomes possible to provide a coating on the platen which assists heat transferred by radiation.

With this in mind, the applicants have investigated the desirable properties of the coating and have realised that, as well as being unaffected by high temperatures (e.g. above 200° C.) the coating should normally have one or more of the following features.

1. It is desirable that the coating have a high emissivity. In general, the emissivity of the coating on the platen should be equal to or preferably greater than the emissivity of the workpiece. It is preferable for the emissivity of the coating of the platen to be greater than that of the workpiece, since the emissivity of the workpiece may increase during processing, e.g. by the deposition of a layer of metal on the surface. Subsequently, the quantity of radiation emitted from the workpiece may be comparable with the quantity of radiation absorbed by the workpiece, as the temperature of the workpiece approximates the temperature of the platen. Thus, where the workpiece is a silicon wafer, the emissivity at wavelength 1 μm should be equal to or preferably greater than 0.7.

2. It is desirable that the coating is produced by plasma spraying. The use of a plasma spray to form the coating is important because it gives the coating a non-crystaline structure; and good adhesion of the coating, reducing the risk of particles being shed; and produces a hard, wear resistant coating.

3. It is desirable that the coating has a minimum thickness of 10 μm. The applicants have found that thicknesses less than this do not always provide a sufficiently high effect.

4. It is desirable that the coating has a thickness less than 50 μm. If the coating is greater than this, the heat conductivity of the coating itself may become a problem.

5. It is desirable that the coating provides a roughened surface. This feature is particularly important where gas is emitted into the space between the workpiece and the platen. A rough texture on a microscopic scale improves the heat transfer between the gas and the platen. Thus, for example, the coating may have a surface roughness of 3 to 5 μm. Alternatively, the surface may have a large number of pores so that the gas molecules make multiple collisions with the platen surface. This has the further advantage that if the thermal resistance of the gas/platen interface is reduced, a lower gas pressure is required and hence the stress on the workpiece caused by the gas is reduced.

6. It is desirable that the coating comprises a high emissivity metal oxide, particularly for high vacuum treatment systems. Such a high emissivity metal oxide has good temperature stability, corrosion resistance, and mechanical wear resistance. The coating should not degrade or outgas under reduced pressure, because this would contaminate the process or the workpiece. For example, chromium oxide is suitable. Good resistance to chemical attack allows chemical cleaning of the platen. For systems where less stringent cleanliness levels are required, black high-temperature paints such as that known by the Trade Mark SPEREX may be suitable.

With the present invention, the platen normally absorbs the majority of incident radiation within the enclosure, and so preferably possesses a high thermal conductance to improve the uniformity of the temperature distribution within the workpiece. Thus, a metallic platen is preferred. Furthermore, the platen may be provided with means for heating and/or cooling to control its temperature.

The present invention may be used where the workpiece rests on the platen, or there may be clamping of the workpiece to the platen. The latter is necessary where a gas is introduced into the space between the workpiece and the platen, to avoid the gas pressure disturbing the workpiece. Where gas is present, that gas may be chosen in order to improve the heat transfer between the platen and the workpiece. It is known that low molecular weight gases have the highest intrinsic thermal conductivity, and therefore the standard choice for the gas between the wafer and the platen is helium. However, the applicants have realised that a light diatomic or polyatomic gas can provide more modes of energy transfer with a solid surface than a monatomic gas such as helium, and therefore the use of such a light diatomic or polyatomic gas between the workpiece and the platen is an independent aspect of the present invention.

A further aspect of the present invention concerns the mounting and dismounting of the workpiece on the platen. It is proposed that the platen is movable within the enclosure relative to plurality of pins. With the workpiece resting on the platen, the platen can be slid axially relative to the pins until its surface adjacent the workpiece has moved from a position lying beyond the ends of the pins to a position in which the ends of the pins project beyond that surface. Then, the workpiece is supported on the pins and it becomes possible to pass a transferring mechanism between the workpiece and the platen, to permit the workpiece to be removed. Similarly, the transferring mechanism may position the workpiece above the pins, the pins then move to support the workpiece, the transferring mechanism removed, and the platen slid on the pins to support the workpiece. The pins may extend directly through the platen, or there may be a block of e.g. insulating material fast with the platen through which the pins extend.

BRIEF DESCRIPTION OF THE DRAWINGS

Embodiments of the present invention will now be described in detail, by way of example, with reference to the accompanying drawings, in which.

DETAILED DESCRIPTION

Figure 1:
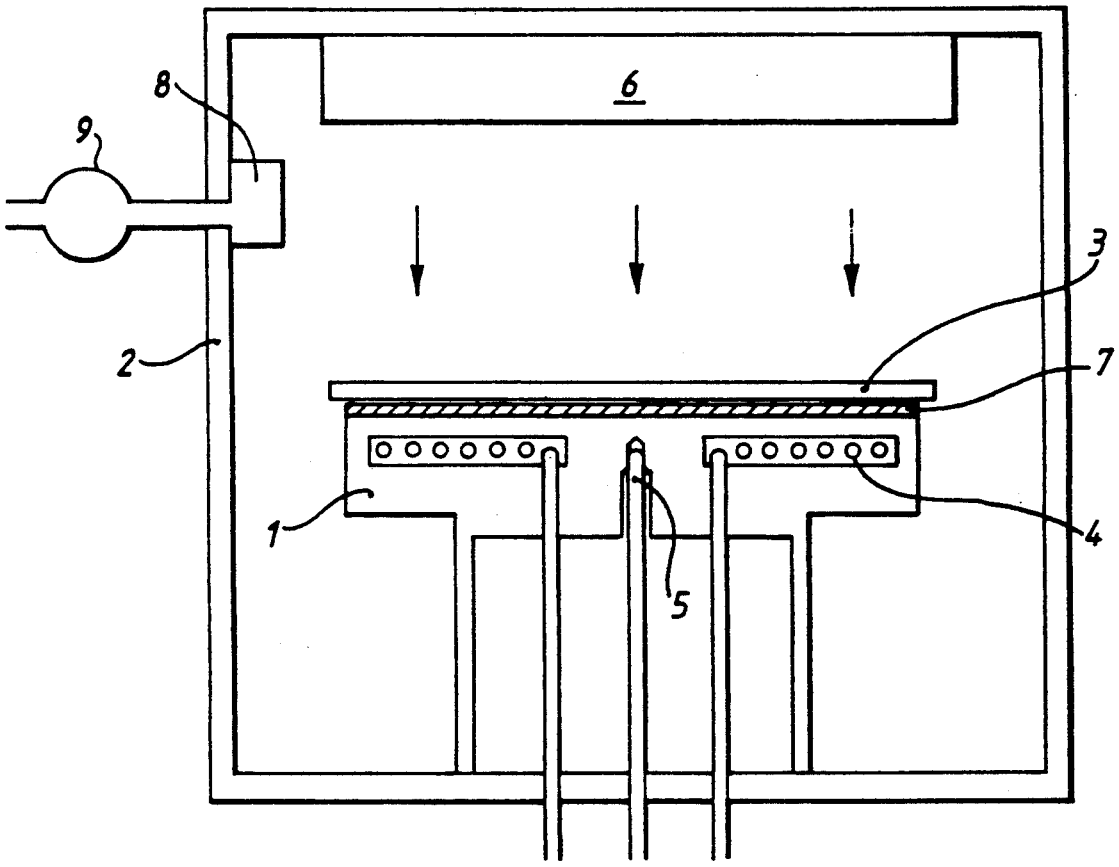
FIG. 1 shows a first embodiment of the present invention.

Referring first to FIG. 1, there is shown a platen 1 within an enclosure forming a vacuum processing chamber 2. A workpiece such as a semiconductor wafer 3 is supported on the platen 1, and is heated by radiation from the platen 1 to the required process temperature. The heat for this is generated by a heating element 4 embedded within the platen 1, with the temperature of the platen being measured by a thermocouple 5. Once the wafer 3 is at the desired temperature, a film may be deposited on the wafer 3 by physical or chemical vapour deposition from a source 6, to achieve the necessary processing of the wafer 3. That deposition may cause further heating of the wafer 3, and heat should then pass to the platen 1.

In order to improve heat transfer between the platen 1 and the wafer 3, and vice versa, the present invention proposes that the platen 1 has a coating 7 thereon, which coating has a high emissivity, equal to or preferably greater than to the emissivity of the wafer 3, to achieve satisfactory radiative heat transfer therebetween. Where the processing within the chamber 2 is to be under high vacuum (the pressure is reduced by the extraction of air via an outlet valve 8 by a pump 9), the coating may be a high emissivity metal oxide such as chromium oxide (e.g. that known under the trade name METCO 106F) of thickness 25 to 50 μm. Such a coating will have an emissivity of around 0.8 at a wavelength of 1 μm and a surface roughness of 3 to 5 μm. This is suitable where the workpiece is a silicon wafer since the emissivity of such a wafer is around 0.7. For systems where less stringent cleanliness levels are required, the coating may be a matt black high-temperature paint such as that known as SPEREX which has an emissivity greater than 0.95 at a wavelength of 1 μm or even black anodisin techniques may be satisfactory.

This method is particularly satisfactory where a workpiece temperature is to be controlled above 200° C. but the preferred working temperature range is between 300° and 650° C.

Figure 2:
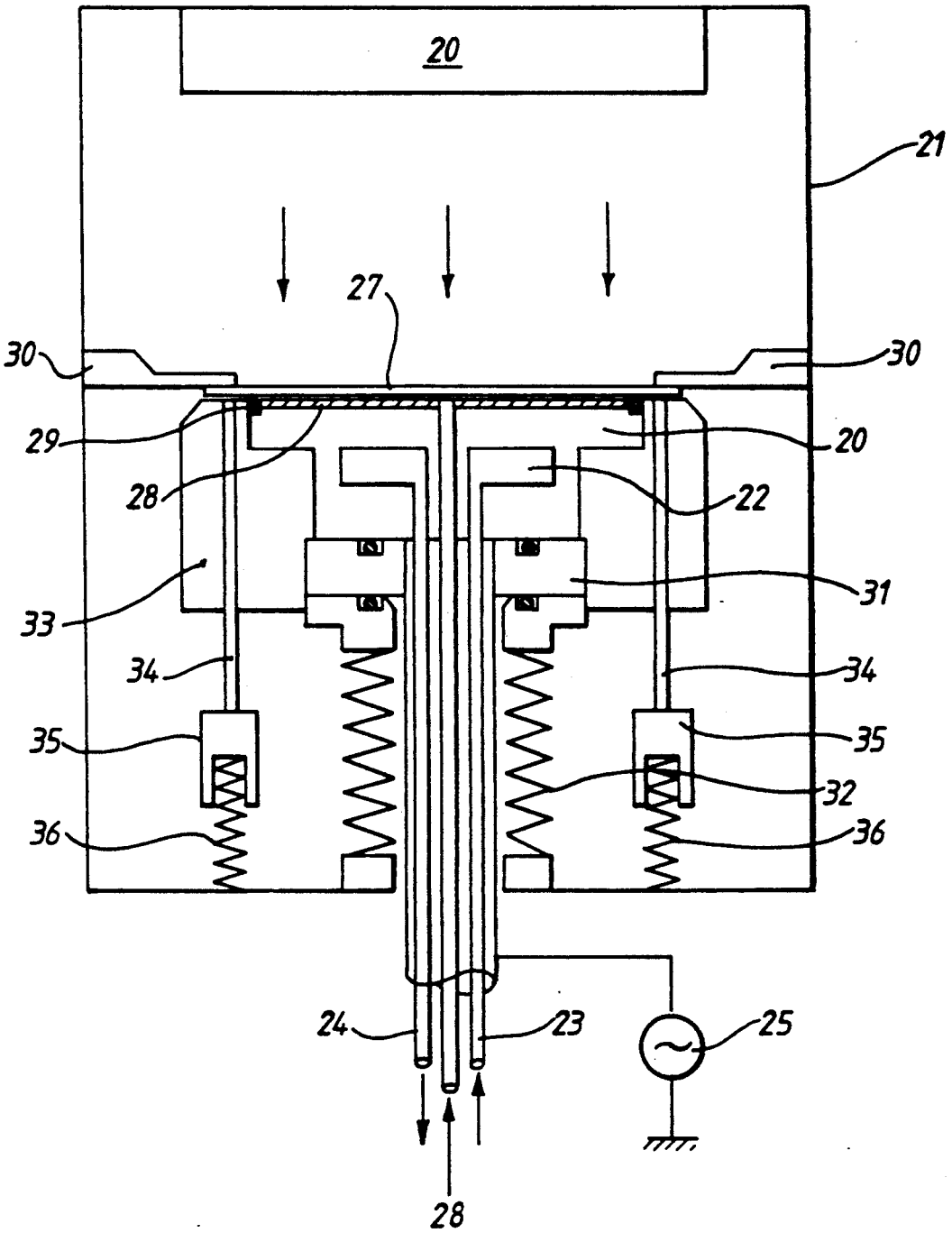
FIG. 2 shows a second embodiment of the present invention.

Referring now to the second embodiment, FIG. 2 shows a platen 20 mounted within a vacuum processing chamber 21. As in FIG. 1 the platen temperature may be controlled by the flow of fluid through an internal channel 22 in the platen 20, which internal channel 22 communicates with an inlet duct 23 and an outlet duct 24. The platen may be connected to a source 25 of RF power for controlling the processing. Also, as in FIG. 1, there is a source 26 for providing flux for treating a workpiece 27 mounted on the platen. As in the embodiment of FIG. 1, the platen 20 has a coating 28 thereon, and this coating may be the same or similar to that already described.

In the embodiment of FIG. 2, heat transfer gas is supplied to the back of the wafer 27 via an inlet duct 28, and seals 29 are provided at the edge of the platen 20 so that the gas cannot escape into the rest of the chamber 21, which could affect the process being carried out on the wafer. The heat transfer gas is supplied to a typical pressure of 0.5 Torr to 8 Torr, to improve the heat transfer from the wafer 27 to the platen 20 in a way that has been described earlier. The pressure is reduced by extraction of air via an outlet valve 8, by a pump 9, as shown in FIG. 1. In order to ensure that the gas pressure does not lift the wafer 27 from the platen 20, clamping pieces 30 are provided in the chamber 21 directly above the platen 20, so that when the wafer 27 is in the position that it is to be processed, it is clamped between the platen 20 and the clamping pieces 30.

As shown in FIG. 2, the platen 20 is mounted on an insulating block 31, which block 31 is connected via a bellows 32 to the wall of the chamber. Thus, the ducts 23, 24 and 28 may pass within the bellows 32. A further insulating piece 33 surrounds the platen. Pins 34 pass through that insulating piece 33, which pins 34 terminate in blocks 35 which are mounted on the lower wall of chamber 21 via springs 36.

Consider now the removal of the wafer 27 from the platen, from the position shown in FIG. 2. If the platen 20 is lowered, the insulating piece 33 slides downwardly on the pins 34, so that the ends of the pins 34 remote from the blocks 35 project from the upper surface of the insulating piece 33. The lowering of the platen 20 lowers the wafer 27, but that lowering of the wafer 27 is limited by the tops of the pins 34. Therefore, as the platen is lowered, the wafer 27 is lifted from the surface of the platen 20 so that it is supported on the pins 34. IF the platen 20 is lowered further, the lower surface of the insulating piece 33 abuts against the top of the blocks 35 and, as the platen is further lowered, the blocks 35 are pressed downwardly against the resistance of the springs 36, and this lowers the wafer 27 so that it is clear of the clamping pieces 30. In this position, with the wafer 27 supported only on the pins 34, it is relatively simple to pass a suitable support mechanism (not shown) between the pins 34 to lift the wafer 27 clear of those pins for removal from the chamber 21. Indeed, the lowering of the wafer 27 as the blocks 35 are pressed downwardly, may be used to lower the wafer 27 onto the support mechanism.

In a similar way, a workpiece 27 may be mounted on the platen 20 by locating it in a position above the platen 20 and the pins 34, in a position where the platen 20 is fully lowered so that the blocks 35 fully compress the springs 36. Then, as the platen is raised, the pins 34 move upwardly due to the resilience of the springs 36, so that the wafer 27 may be lifted off the support mechanism. That support mechanism may then be withdrawn before the platen 20 is raised further to the position shown in FIG. 2 where the raising of the platen 20 lifts the wafer 27 clear of the end of the pins 34.

Of course, many variations in the embodiments disclosed are possible. For example, the springs 36 may be replaced by other suitable biasing means, or the pins 34 could pass through the platen itself, rather than through the insulating piece 33. In FIG. 2, the platen 20 could be heated or cooled by the heating mechanism shown in FIG. 1 or the platen of FIG. 1 can be heated or cooled by the means of FIG. 2.

The gas introduced via the duct 28 into the space between the wafer 27 and platen 20 in FIG. 2 may be helium, which has been used in existing gas systems, but is preferably a light diatomic or polyatomic gas such as methane, ammonia, $N_2$ or $H_2$.

Although the present invention has been described with reference to supporting a semiconductor wafer on a platen, it is applicable to the supporting of other workpieces where it is important to transfer heat between the workpiece and the platen.

We claim:

1. An apparatus for supporting a workpiece comprising:

an enclosure;

means for reducing the pressure within the enclosure;

a platen in the enclose for supporting a workpiece on a surface thereof, said surface of the platen having a coating for assisting heat transfer between the workpiece supported on the platen and the platen, said coating having an emissivity not less than the emissivity of the workpiece; and means for heating the workpiece supported on the platen to a temperature of at least 200° C., said workpiece having an emissivity not greater than that of said coating.

2. An apparatus according to claim 1, wherein the coating has a thickness not less than 25 μm.

3. An apparatus according to claim 1, wherein the coating has a thickness not greater than 50 μm.

4. An apparatus according to claim 1, wherein the coating has a roughened surface.

5. An apparatus according to claim 1, wherein the coating is formed by plasma spraying.

6. An apparatus according to claim 1, wherein the means for heating the workpiece is within said platen.

7. An apparatus according to claim 1, wherein the apparatus includes means for introducing a gas between the platen and the workpiece.

8. An apparatus according to claim 7 wherein the gas comprises a polyatomic gas.

9. An apparatus according to claim 1, wherein the platen is movable within the enclosure between an operative position and a withdrawn position, and wherein there are a plurality of pins in the enclosure adjacent the platen, the pins extending in a first direction such that, when the platen is in its operative position, the ends of the pins do not project beyond the surface of the platen for supporting the workpiece, and when the platen is in its withdrawn position, the ends of the pins project beyond the surface.

10. An apparatus according to claim 1, wherein said coating is a refractory metal oxide.

11. An apparatus as recited in claim 1 wherein said coating has an emissivity of at least 0.7.

12. A method of treating a workpiece, comprising the steps of:

mounting said workpiece on a surface of a supporting platen, said supporting platen being within an enclosure, said surface having a coating thereon for assisting heat transfer between the workpiece and the platen, which coating has an emissivity not less than the emissivity of the workpiece;

reducing the pressure within the enclosure; and heating the workpiece to a temperature of at least 200° C.

13. A method as recited in claim 12 further comprising the step of introducing a gas between the platen and the workpiece.

14. A method as recited in claim 13 wherein said gas comprises a poly atomic gas at a pressure of 0.5 to 8 Torr.

15. A method as recited in claim 12 further comprising the step of depositing a film on said workpiece by physical or chemical vapour deposition.

* * * * *